US008661924B2

(12) United States Patent
Atluru et al.

(10) Patent No.: US 8,661,924 B2
(45) Date of Patent: Mar. 4, 2014

(54) STARTER WITH ROCK BACK AND OSCILLATION ABOSRBERS

(75) Inventors: Ravi Atluru, Westland, MI (US); Wei Xue, Northville, MI (US); Eric Twigg, Ypsilanti, MI (US)

(73) Assignee: Ford Global Technologies, Dearborn, MI (US)

( * ) Notice: Subject to any disclaimer, the term of this patent is extended or adjusted under 35 U.S.C. 154(b) by 393 days.

(21) Appl. No.: 12/758,845

(22) Filed: Apr. 13, 2010

(65) Prior Publication Data

US 2011/0247437 A1 Oct. 13, 2011

(51) Int. Cl.
*F02N 15/06* (2006.01)

(52) U.S. Cl.
USPC ..... 74/7 R; 74/6

(58) Field of Classification Search
USPC ..... 74/6, 7, 7 R
See application file for complete search history.

(56) References Cited

U.S. PATENT DOCUMENTS

| | | | | |
|---|---|---|---|---|
| 1,625,793 | A * | 4/1927 | Chilton | 74/7 R |
| 1,972,867 | A | 9/1934 | Butler | |
| 2,388,450 | A | 11/1945 | Thompson | |
| 2,944,428 | A * | 7/1960 | Antonidis et al. | 74/7 R |
| 4,779,470 | A * | 10/1988 | Morita et al. | 74/7 R |
| 4,795,402 | A | 1/1989 | Reichardt | |
| 5,127,279 | A | 7/1992 | Barthruff | |
| 5,591,083 | A | 1/1997 | Kirschey | |
| 6,416,416 | B1 | 7/2002 | Rohs et al. | |
| 7,373,908 | B2 | 5/2008 | Rizoulis et al. | |
| 7,401,585 | B2 | 7/2008 | Shirataki | |
| 2003/0153389 | A1 | 8/2003 | Rohs | |

* cited by examiner

*Primary Examiner* — David M Fenstermacher
*Assistant Examiner* — Terence Boes
(74) *Attorney, Agent, or Firm* — Angela M. Brunetti; Frank MacKenzie

(57) ABSTRACT

A system and method for absorbing rock-back and oscillation in a drive assembly of an engine start-stop device. The drive assembly has a pinion with at least two slots that receive axially extending protrusions of a barrel element. Damping elements in the slots and a spring element absorb rock-back and impact oscillations.

5 Claims, 2 Drawing Sheets

STARTER WITH ROCK BACK AND OSCILLATION ABOSRBERS

TECHNICAL FIELD

The invention relates to an electric starting motor for an engine and more particularly to a starter device with axial and torsion flexibility for start-stop systems.

BACKGROUND

Automotive vehicles typically employ an electrical starting motor to crank and start the vehicle engine. In a regular driving strategy, an engine continues to run once it is cranked by the starting motor. However, to improve fuel economy and reduce emissions, a start-stop engine cranking strategy has been applied. In a start-stop engine cranking strategy, the engine is turned off when the vehicle is stopped for a predetermined period of time. When a driver intends to move the vehicle, the engine is re-started.

In order to accomplish this, an electric starting motor is typically used. The electric starting motor has a pinion that is permanently engaged with a ring gear that connects to the engine. In this application, the starting motor does not have an overrun clutch such as is typically used in a regular starting motor system. In the start-stop strategy, the overrun clutch is instead placed in a flywheel, or drive plate, where the engine ring gear is located. However, with this configuration, when the engine is stopped, the ring gear attached to the engine crank shaft rocks back and oscillates due to the fact that the starter pinion cannot rotate with the ring gear. The result is an impact from the ring gear to the starter pinion, which causes unwanted impact noise and potential damage to the starter.

Accordingly, there is a need for a start-stop device that reduces impact from the ring gear to the starter pinion that will eliminate unwanted noise while protecting the starter from damage.

SUMMARY

In an exemplary embodiment of the present invention, a start-stop device with axial and torsion flexibility that absorbs oscillation impact and reduces impact noise thereby protecting the starter is provided. The device allows a starter pinion to rotate with ring gear, thereby avoiding a hard impact. An oscillation impact absorber reduces the impact and oscillation of the ring gear.

The exemplary embodiment of the starter system has a pinion with two slots. A barrel has at least two axially extending protrusions that are received by the pinion slots. A spring element is coupled to the pinion. The system transforms rotational impact to linear impact and the linear impact is absorbed by the spring. Damping elements may be positioned in the slots filling the space between the axially extending protrusions of the barrel. The damping elements may be a solid rubber, a spring, or a combination of springs.

DESCRIPTION OF DRAWINGS

The invention will be understood from the detailed description and the accompanying drawings wherein.

Elements and steps in the figures are illustrated for simplicity and clarity and have not necessarily been rendered according to any particular sequence. For example, steps that may be performed concurrently or in different order are illustrated in the figures to help improve understanding of embodiments of the present invention.

DESCRIPTION OF INVENTION

While various aspects of the present invention are described with reference to a particular illustrative embodiment, the invention is not limited to such embodiments, and additional modifications, applications, and embodiments may be implemented without departing from the present invention. In the figures, like reference numbers will be used to illustrate the same components. Those skilled in the art will recognize that the various components set forth herein may be altered without varying from the scope of the inventive subject matter.

Figure 1:
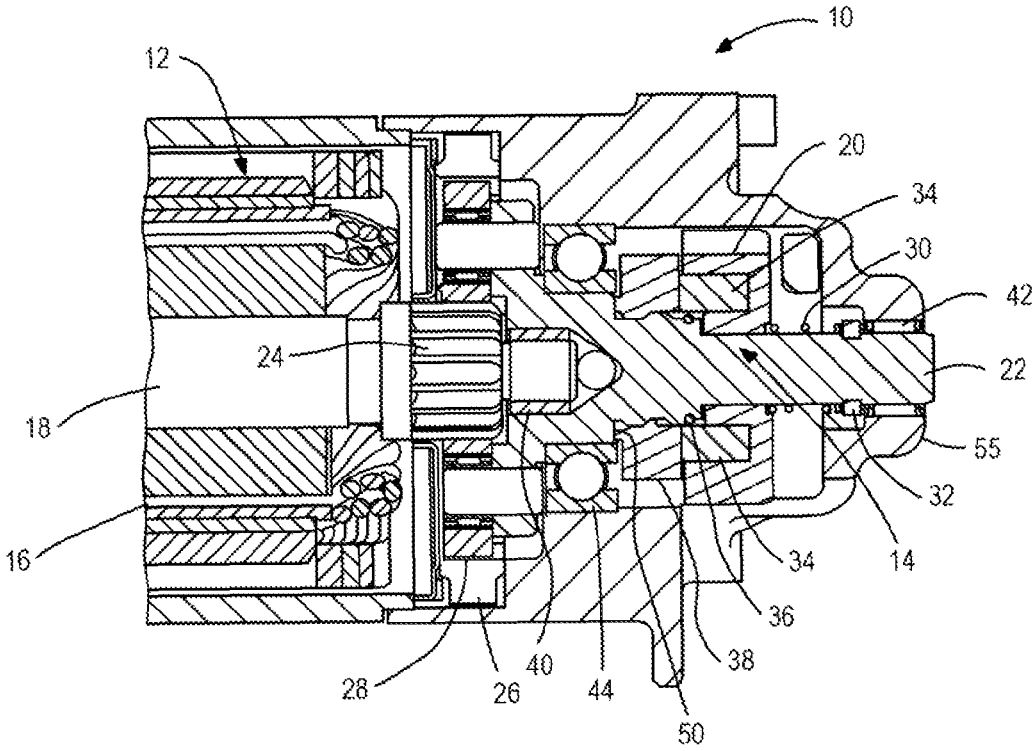
FIG. 1 is a cross-sectional view of the device of the present invention.

FIG. 1 is a cross-sectional view of a starter device 10 of the present invention. An electric motor 12 is engaged with a drive assembly 14. The electric motor 12 has an armature 16 having an armature shaft 18 that drives a pinion 20 of the drive assembly 14 when the starter motor 12 is energized. An output shaft 22 of the drive assembly 14 is driven by the electric motor 12 through an epicyclical gear system having armature shaft gear 24, stationary gear 26 and planetary gears and bearings 28. During engine cranking, the electric motor 12 is energized and the armature 16 of the electric motor 12 drives the pinion 20 through the epicyclical gear system and the output shaft 22.

Figure 2:
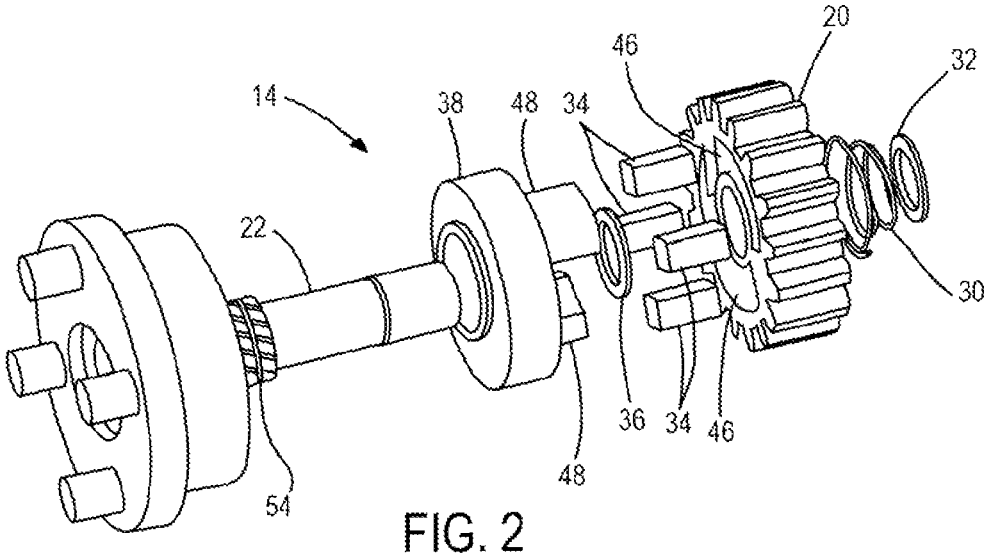
FIG. 2 is an exploded view of an output shaft assembly having the start-stop device of the present invention.
Figure 3:
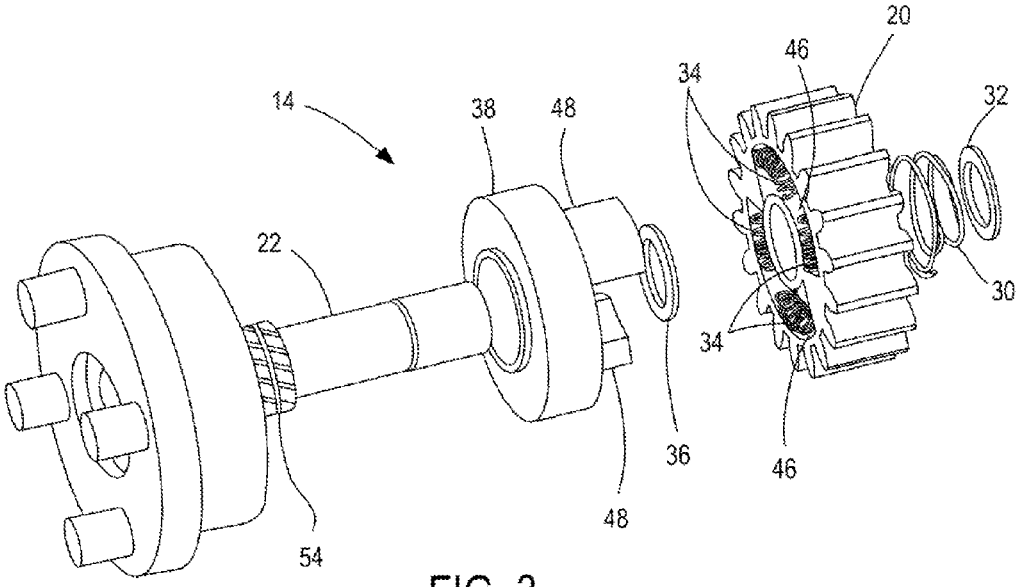
FIG. 3 is a view of the start-stop device of the present invention having damping elements that are compound springs.

FIG. 2 is an exploded view of the drive assembly 14. The drive assembly 14 consists of the pinion 20, a spring 30, a first snap ring 32, the output shaft 22, a plurality of damping elements 34, a second snap ring 36, a barrel 38, and a shaft bearing 40 (shown in FIG. 1). The drive assembly 14 is located in proximity to the electric starter motor by a housing bearing 42 and a shaft bearing 44 as shown in FIG. 1. Referring again to FIG. 2, the pinion 20 has two slots 46 that receive two protrusions 48 on the barrel 38. In the example shown in FIG. 2, the slots 46 are axial slots and the slots 46 and protrusions 48 are semi-circular in shape. Damping elements 34 are located in the slots 46 in a space between the edges of the slots 46 in the pinion 20 and the outer edges of the protrusions 48 on the barrel 38. The damping elements may be of a rubber material and fill the spaces between the protrusions 48 and the barrel 38. Alternatively, the damping elements may be a spring, or a compound spring having a variety of shapes as shown in FIG. 3. The second snap ring 36 is located between the barrel 38 and the pinion 20.

The protrusions 48 extend axially from the barrel 38 and are designed to fit into the axial slots 46 of the pinion 20. The barrel 38 is engaged with the output shaft 22 by a helical spline 54. The output shaft 22 has a step 50 (shown in FIG. 1) on its outer diameter which, along with the second snap ring 36, locates and axially restricts the barrel 38 relative to the output shaft 22. When the barrel 38 rotates against the output shaft 22, the barrel 38 will move axially along the output shaft 22 within the axial restriction of the step 50 and second snap ring 36. The pinion 20 is pressed toward the barrel 38 by the spring 30 and the first snap ring 32 which are held against the pinion 20 by a housing 55 (shown in FIG. 1).

In operation, the output shaft 22 rotates and the pinion 20 moves towards and compresses the spring 30. The ring gear (not shown) on the engine cranking shaft (also not shown) resists the rotation of the pinion 20 and the helical spline 54 on the output shaft 22 pushes the barrel 38. The drive assembly 14 is stopped by the first snap ring 32 and the pinion 20 drives the ring gear (not shown) to crank the engine.

Once the engine is running, the electric motor 12 is de-energized and the drive assembly 14 is pushed back to its initial position. When the engine stops, the engine crank shaft (not shown) rocks back and the drive assembly 14 and the ring gear (not shown) rotate. The rotation of the ring gear drives the rotation of the pinion 20. The rotation of the pinion 20 moves the pinion 20 to compress the spring 30 as a result of the helical spline 54 on the output shaft 22. Thus, according to the present invention, rotational impact is transformed into a linear impact and absorbed by the spring 30. Oscillation of the ring gear (not shown) caused by rock back of the engine crank shaft (not shown) is absorbed by the damping elements 34.

In a typical starter, when the engine stops, the ring gear attached to the engine crank shaft will rock back and oscillate while the starter pinion cannot rotate with the ring gear. The result is an unwanted impact from the ring gear to the starter pinion, which is harmful to the starter. According to the present invention, the starter is protected from impact noise because the starter has torsion flexibility in the design and interaction of the barrel 38 and the pinion 20. The present invention also protects the starter from oscillation impact absorption in the damping elements 34. The present invention allows the starter pinion 20 to rotate with the ring gear thereby avoiding hard impact and the spring 30 absorbs oscillation impact along with damping elements 34, thereby reducing the impact oscillation from the ring gear. According to the present invention, the damping solution is integrated into the pinion 20 of the starter motor.

In the foregoing specification, the invention has been described with reference to specific exemplary embodiments. Various modifications and changes may be made, however, without departing from the scope of the present invention as set forth in the claims. The detailed description and figures are illustrative, rather than restrictive, and modifications are intended to be included within the scope of the present invention. Accordingly, the scope of the invention should be determined by the claims and their legal equivalents rather than by merely the examples described.

For example, the steps recited in any method or process claims may be executed in any order and are not limited to the specific order presented in the claims. The components and/or elements recited in any apparatus claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

The terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

What is claimed is:

1. An engine start-stop cranking system that absorbs rock-back and oscillation comprising:

an electric motor having an armature assembly;

a drive assembly coupled to the armature assembly of the electric motor wherein the drive assembly further comprises:

a pinion having at least two slots;

a barrel having at least two axially extending protrusions received by the at least two slots of the pinion;

a plurality of damping elements being positioned in each slot on each side of each protrusion and in contact with each side of each protrusion; and a spring element coupled to the pinion whereby rotational movement of the barrel compresses the spring thereby transforming rotational impact to linear impact that is absorbed by the spring.

2. The engine start-stop cranking system according to claim 1 wherein the damping elements are a rubber material that fills a space between the at least two slots and the at least two axially extending protrusions.

3. The engine start-stop cranking system according to claim 1 wherein the damping elements are spring elements.

4. The engine start-stop cranking system according to claim 3 wherein the damping elements are compound spring elements.

5. The engine start-stop cranking system according to claim 1 wherein the at least two slots and the at least two protrusions are semi-circular in shape.

* * * * *